US008066447B2

(12) United States Patent
Brandstrom

(10) Patent No.: US 8,066,447 B2
(45) Date of Patent: Nov. 29, 2011

(54) WOOD MAT AND APPARATUS AND METHOD FOR ASSEMBLING SAME

(76) Inventor: Randel Brandstrom, Edmonton (CA)

( * ) Notice: Subject to any disclaimer, the term of this patent is extended or adjusted under 35 U.S.C. 154(b) by 859 days.

(21) Appl. No.: 11/769,356

(22) Filed: Jun. 27, 2007

(65) Prior Publication Data

US 2008/0028703 A1 Feb. 7, 2008

Related U.S. Application Data

(60) Provisional application No. 60/835,071, filed on Aug. 3, 2006.

(51) Int. Cl.
*E01C 5/14* (2006.01)

(52) U.S. Cl. ..... 404/46; 404/72; 144/353

(58) Field of Classification Search ..... 404/34, 404/35, 46, 72, 73; 52/747.1; 144/344, 345, 144/353

See application file for complete search history.

(56) References Cited

U.S. PATENT DOCUMENTS 1,935,823 A * 11/1933 Turner ..... 404/46
4,289,420 A * 9/1981 Davis et al. ..... 404/35
4,462,712 A 7/1984 Penland, Sr.
4,600,336 A 7/1986 Waller, Jr.
4,600,337 A 7/1986 Sarver
4,875,800 A 10/1989 Hicks
4,889,444 A * 12/1989 Pouyer ..... 404/34
4,973,193 A 11/1990 Watson et al.
5,020,937 A 6/1991 Pouyer
5,032,037 A 7/1991 Phillips et al.
5,087,149 A 2/1992 Waller, Jr.
5,163,776 A * 11/1992 Pouyer ..... 404/35
5,234,204 A * 8/1993 Hunt ..... 269/41
5,273,373 A * 12/1993 Pouyer ..... 404/35
5,316,408 A 5/1994 Stanley et al.
5,822,944 A 10/1998 Penland, Sr.
6,039,512 A * 3/2000 Chooi et al. ..... 406/85
6,099,212 A * 8/2000 Marocco ..... 408/3
6,474,905 B1 * 11/2002 Smith et al. ..... 404/35
6,745,452 B1 6/2004 Harrison
6,874,972 B2 4/2005 Davis et al.
6,945,732 B2 * 9/2005 Renick ..... 404/35
7,210,211 B2 * 5/2007 Harrison ..... 29/525.02
7,427,172 B2 * 9/2008 Lukasik ..... 404/36

* cited by examiner

*Primary Examiner* — Gary S Hartmann
(74) *Attorney, Agent, or Firm* — Adrian D. Battison; Ade & Company Inc.

(57) ABSTRACT

A wood mat has a first layer of timbers extending parallel to one another in a longitudinal direction and a second layer timbers spanning across the first timbers parallel to one another and transversely to the first timbers such that each second timber intersects a plurality of the first timbers at respective intersecting locations of the mat; and a plurality of pressed fasteners mounted at selected intersecting locations through drilled holes formed by either a rivet fastener or a press fit fastener having opposed ends compressively joining the timbers therebetween.

13 Claims, 6 Drawing Sheets

WOOD MAT AND APPARATUS AND METHOD FOR ASSEMBLING SAME

This application claims the benefit under 35 U.S.C. 119 of Provisional Application 60/835,071 filed Aug. 3, 2006.

FIELD OF THE INVENTION

The present invention relates to wood mat formed of layers of timbers, for example temporary road mats or work area mats, and more particularly relates to a method and an apparatus for assembling the wood mats.

BACKGROUND

Wood mats, for example temporary road mats or work area mats of the type used in oil, logging and mining industries, are known to facilitate equipment transportation or vehicle traffic in areas where permanent roads are non-existent or too expensive and were the ground is not stable enough to regularly support heavy equipment. Wood mats often comprise multiple layers of wooden boards or timbers which are fastened together so that each layer of timbers spans across the timbers of a previous layer in an intersecting manner. Fastening is required at these intersections. Some mats may be provided with interlocking portions in the form of fingers receivable within openings in adjacent mats to connect multiple mats in series to form a road way.

The following U.S. patents disclose various examples of temporary mats of the type used in roadways and the like for example, U.S. Pat. No. 6,745,452 to Harrison; U.S. Pat. No. 5,032,037 to Phillips et al.; U.S. Pat. No. 4,600,336 to Waller, Jr.; U.S. Pat. No. 6,874,972 to Davis et al.; U.S. Pat. No. 5,316,408 to Stanley et al.; U.S. Pat. No. 5,087,149 to Waller, Jr.; U.S. Pat. No. 5,020,937 to Pouyer; U.S. Pat. No. 4,973,193 to Watson et al., U.S. Pat. No. 4,875,800 to Hicks; U.S. Pat. No. 4,600,337 to Sarver, U.S. Pat. No. 4,462,712 to Penland, Sr.; and U.S. Pat. No. 5,822,944 to Penland, Sr.

In each instance in the prior art, fastening each timber to the intersecting timbers of adjacent layers is particularly labour intensive, resulting in costly labour to manufacture the mats. Furthermore known fastening types are either known to loosen or protrude after assembly so that in either instance protrusions result which can potentially cause damage to vehicle tires.

SUMMARY OF THE INVENTION

According to one aspect of the invention there is provided a wood mat comprising:

a first layer comprising a plurality of elongate first timbers extending parallel to one another in a longitudinal direction between first and second ends of the mat;

a second layer comprising a plurality of elongate second timbers spanning across the first timbers, parallel to one another and transversely to the first timbers such that each second timber intersects a plurality of the first timbers at respective intersecting locations of the mat; and a plurality of pressed fasteners mounted at selected intersecting locations, each pressed fastener joining one of the first timbers of the first layer to one of the second timbers of the second layer.

According to a second aspect of the present invention there is provided a wood mat comprising:

a first layer comprising a plurality of elongate first timbers extending parallel to one another in a longitudinal direction between first and second ends of the mat;

a second layer comprising a plurality of elongate second timbers spanning across the first timbers, parallel to one another and transversely to the first timbers such that each second timber intersects a plurality of the first timbers at respective intersecting locations of the mat; and a plurality of welded fasteners mounted at selected intersecting locations, each welded fastener comprising first and second mating parts welded together to compressively join one of the first timbers of the first layer to one of the second timbers of the second layer between opposing ends of the welded fastener.

When there is provided a third layer comprising a plurality of elongate third timbers spanning across the second timbers, parallel to one another and transversely to the second timbers such that one of the third timbers intersects one of the second timbers at each intersecting location between first and second timbers, preferably one of the fasteners joins one of the first timbers to one of the third timbers with one of the second timbers compressed therebetween at each intersecting location.

According to a further aspect of the present invention there is provided an apparatus for assembling a wood mat comprising a plurality of layers of elongate timbers in which the timbers of each layer span parallel to one another across and transversely to the timbers of an adjacent layer so as to intersect a plurality of the timbers of the adjacent layer at a plurality of respective intersecting locations; the apparatus comprising;

a work support arranged to support the plurality of timbers thereon in said layers with said intersecting locations arranged in lateral rows;

a drilling array arranged to drill holes through the layers of timbers at selected ones of the intersecting locations in one of the rows of the intersecting locations;

a fastener array arranged to mount a fastener within a respective one of the holes formed by the drilling array at the selected ones of the intersecting locations in one of the rows of the intersecting locations so as to compressively join the respective timbers; and an indexing mechanism arranged to displace the work support relative to the drilling array and relative to the fastener array in a longitudinal direction substantially perpendicular to the lateral rows to successively align the drilling array with each successive row of intersecting locations and to successively align the fastener array with each successive row of intersecting locations subsequent to having holes formed therein by the drilling array.

According to another aspect of the present invention there is provided a method of assembling a wood mat comprising a plurality of layers of elongate timbers in which the timbers of each layer span parallel to one another across and transversely to the timbers of an adjacent layer so as to intersect a plurality of the timbers of the adjacent layer at a plurality of respective intersecting locations; the method comprising;

supporting the plurality of timbers on a work support in said layers with said intersecting locations arranged in lateral rows;

providing a drilling array arranged to drill holes through the layers of timbers at the respective intersecting locations in one of the lateral rows of the intersecting locations;

displacing the work support relative to the drilling array in a longitudinal direction substantially perpendicular to the lateral rows such that the drilling array is successively aligned with each lateral row of the intersecting locations;

operating the drilling array at each row of the intersecting locations to form the holes at selected ones of the intersecting locations of the timbers;

providing a fastener array comprising a plurality of fastener mounting devices operable to mount respective fasteners within the holes formed by the drilling array in one of the lateral rows of the intersecting locations;

displacing the work support relative to the fastener array in the longitudinal direction such that the fastener mounting devices of the fastener array are successively aligned with each lateral row of the intersecting locations; and operating the fastener array so as to compressively join the plurality of layers of timbers with one another with the fasteners at the selected ones of the intersecting locations of the timbers.

Use of rivets or other pressed type fasteners mounted by a pressing operation can be assembled quickly with good rigidity and strength, resulting in a flat surface on both top and bottom faces of the mat. The rivets can be inserted by forming presses which are individually controlled to compensate for inconsistent board thickness while ensuring that the boards are compressively joined together at each intersection. The apparatus can be arranged to shift the lateral positioning of drill presses for forming holes to receive the fasteners. In some embodiments using rivets, the apparatus can also be arranged to shift lateral positioning of the rivet presses which press the rivets into the formed holes so that the rivet fasteners can be installed in a linear pattern aligned in the longitudinal direction of the mat, or alternatively the rivet fastener location can be staggered so that certain fasteners are offset laterally in relation to others.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
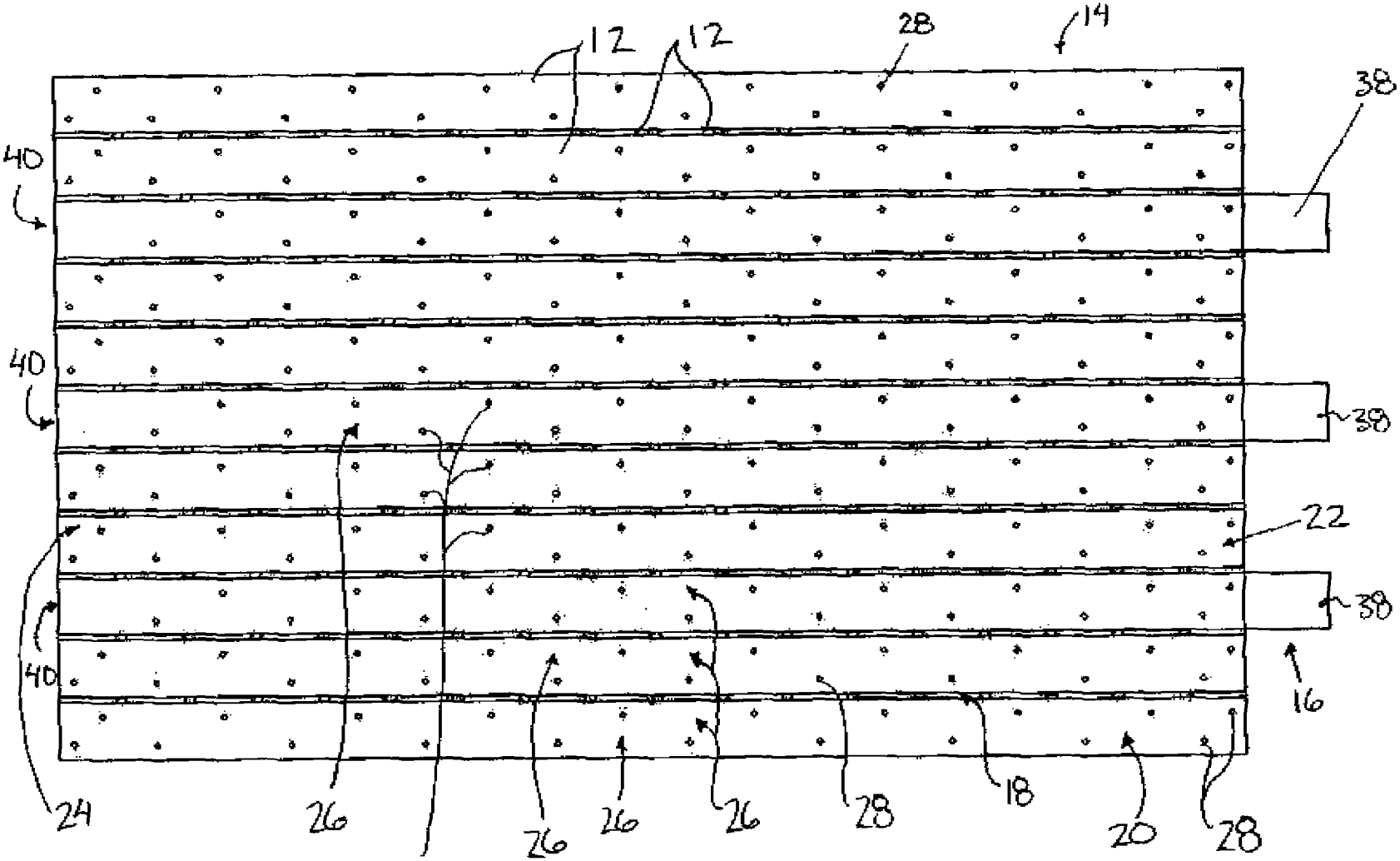
FIG. 1 is a top plan view of a temporary mat.
Figure 2:
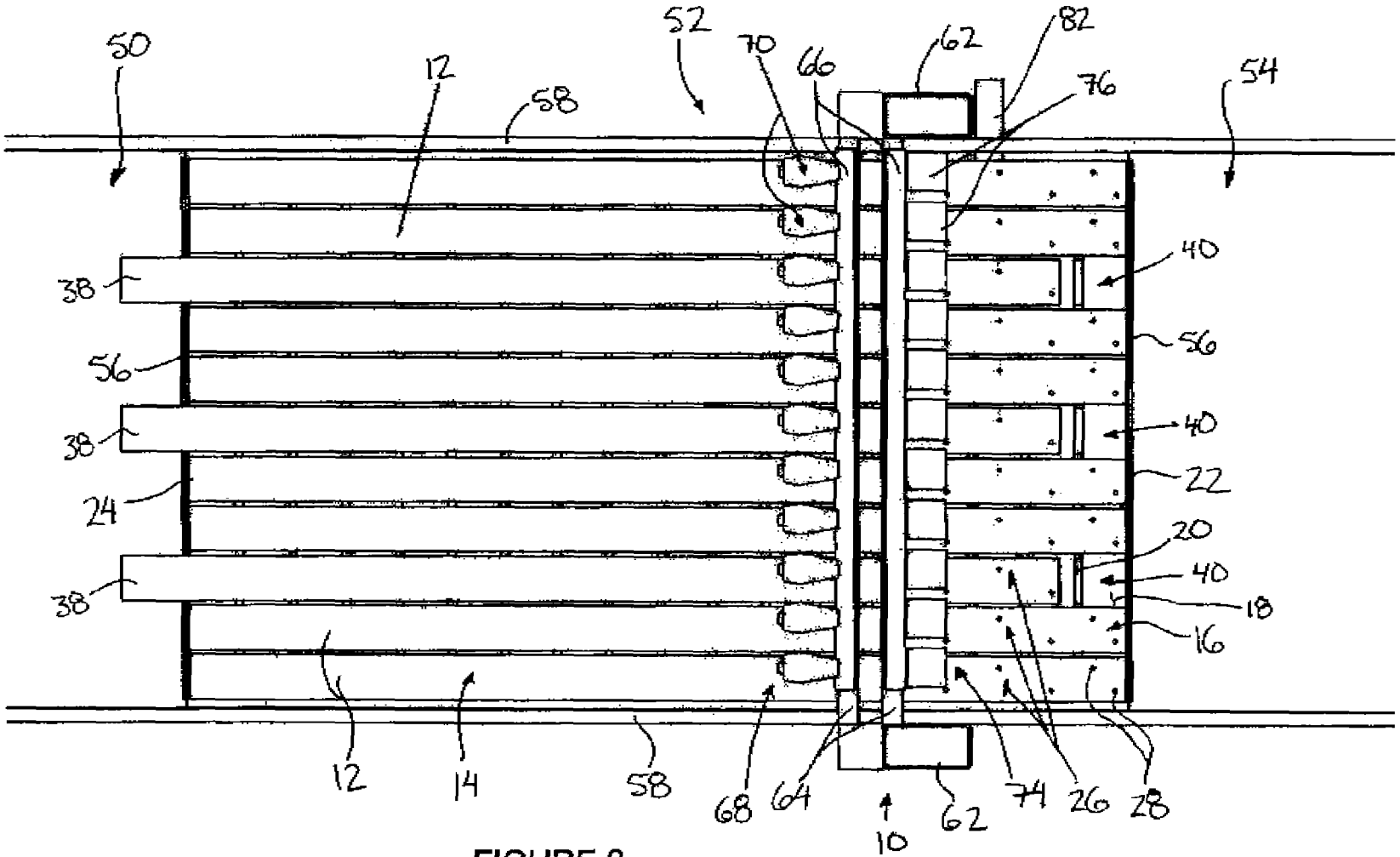
FIG. 2 is a top plan view of the apparatus for assembling mats.

Referring to the accompanying figures there is illustrated a wood mat assembling apparatus generally indicated by reference numeral 10. The apparatus 10 is particularly suited for assembling elongate timbers 12 into a mat 14, for example for use as a temporary road mat or other similar applications where a temporary supporting surface is required.

Figure 6:
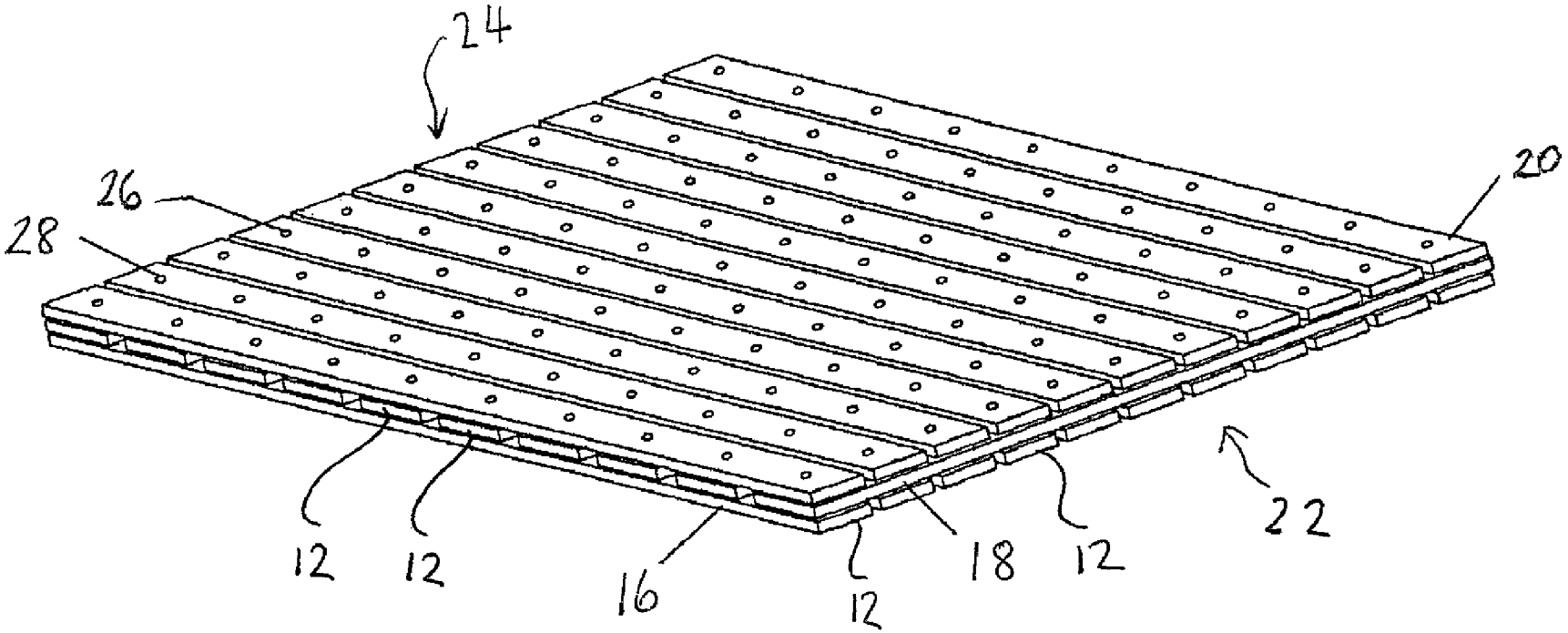
FIG. 6 is an isometric view of the temporary mat of FIG. 1.

The mat 14 is formed of timbers 12 which comprise elongate, rigid, wooden boards of rectangular cross section. The boards are assembled into layers joined together to form the mat. In the illustrated embodiment there is provided a mat with a first bottom layer 16, a second middle layer 18 and a third top layer 20. This arrangement is of course well known is shown in FIG. 6, where in the isometric view the different layers are shown.

The first bottom layer comprises a plurality of timbers 12 which are oriented parallel to one another in close proximity so that the gap between adjacent timbers is considerably smaller than the width of an individual timber. The timbers of the first bottom layer 16 are oriented to lie in a generally common plane in which each timbers extends in a longitudinal direction of the mat between a first end 22 and a second end 24 of the mat.

The second middle layer 18 comprises a plurality of additional timbers 12 which are again oriented parallel to one another and which lie in a common plane in close proximity to one another to define a small gap between adjacent boards. The timbers however are oriented perpendicular to the timbers of the first bottom layer 16 so as to be perpendicular to the longitudinal direction and to extend in a lateral direction between opposing sides of the mat. Each second timber of the middle layer thus spans across the first timbers of the bottom layer 16 to intersect each of the first timbers at an intersecting location 26. The timbers are positioned such that the broadest flat sides thereof lie generally horizontally in abutment with the broadest flat sides of the adjacent layer.

Due to the orientation of the timbers, the intersecting locations are arranged in laterally extending rows in which each lateral row of intersecting locations corresponds to the intersecting locations of one of the second timbers of the middle layer 18 extending in the lateral direction between the sides of the mat. Plural lateral rows of intersecting locations are thus defined, each corresponding to one of the second timbers of the middle layer 18 so that the lateral rows are spaced in the longitudinal direction from one another between the first and second ends of the mat.

The third top layer 20 again comprises a plurality of timbers oriented parallel to one another in close proximity to define a small gap between adjacent timbers. The timbers of the top layer 20 are oriented perpendicularly to the previous layer so that the timbers extend in the longitudinal direction parallel to the first timbers of the bottom layer 16. The third timbers of the top layer 20 are aligned with corresponding ones of the first timbers of the bottom layer 16 so that one of the timbers overlaps each intersecting location between the first and second layers. When fastened at each intersecting location, the second timbers of the middle layer 18 are accordingly joined under compression between a first timber of the bottom layer 16 and a third timber of the top layer 20 at each intersecting location.

Fastening is accomplished by a plurality of rivet fasteners 28 in which at least one fastener is provided at each intersecting location of the timbers. The rivet fasteners initially comprise a rivet blank 30 in the form of at tube which is inserted through a vertical through hole 32 formed at each intersecting location which extends vertically through all of the layers of timbers oriented perpendicularly to the plane of each layer. The tube forming the rivet blank 30 is arranged to be longer than the overall thickness of the three combined layers so that an end portion of the tube extending beyond the outer surface at the top and bottom layers of the timbers can be pressed to be enlarged in diameter and to be engaged directly into the respective outer surface 34 at each of the formed heads 36 of the rivet fasteners after the pressing operation.

A single rivet fastener is provided at most of the intersecting locations. At both ends of the mat the end of each longitudinally extending timber of the first and third layers include a pair of fasteners secured therethrough so that the intersecting locations along the opposed longitudinal ends each include two rivet fasteners 28 formed therein in which the fasteners are offset both in the longitudinal direction and the lateral direction relative to one another. The pair of fasteners at each intersecting location provides resistance against twisting of the assembled mat structure.

In the illustrated embodiment, as shown in FIG. 1 but omitted in FIG. 6 for convenience of illustration, for additional strength against twisting, the rivet fasteners 28, and accordingly the through holes 32 receiving the rivet fasteners, are staggered in such a manner that each lateral row of fasteners is offset in a lateral direction relative to the next adjacent lateral row in a repeating alternating pattern along the longitudinal length of each timber of the first and third layers. When extending along each timber of the first and third layers in the longitudinal direction, the fasteners are accordingly staggered so as to alternate between being nearest to one side edge of the timber and being nearest the other side edge of the timber.

Some of the timbers of the first bottom layer 16 are arranged to project beyond the end of the mat to define a plurality of finger portions 38 at evenly laterally spaced positions across the width of the mat. The length of the finger portions 38 beyond the end of the mat correspond approximately the width of one and a half timbers of the second middle layer 18 as measured in the longitudinal direction. The finger portions 38 thus overlap a portion of two laterally extending boards of the middle layer 18 of an adjacent mat of similar configuration when the mats are abutted end to end for constructing a roadway.

The first layer accordingly has corresponding gaps 40 formed at locations corresponding to the finger portions 38 at the opposing end of the mat which are suitably sized to receive the finger portions 38 of an adjacent mat of similar configuration. The gaps 40 are formed by terminating corresponding ones of the first timbers of the first bottom layer 16 spaced inwardly from the end of the mat by the same distance as the length of the finger portions, that is approximately the width of one and a half timbers of the middle layer 18 as measured in the longitudinal direction of the mat. When connecting a plurality of the mats in series with one another, the fingers of one mat are received within the corresponding gaps 40 in another mat for fastening to the second and third layers of the second mate after assembly.

Figure 3:
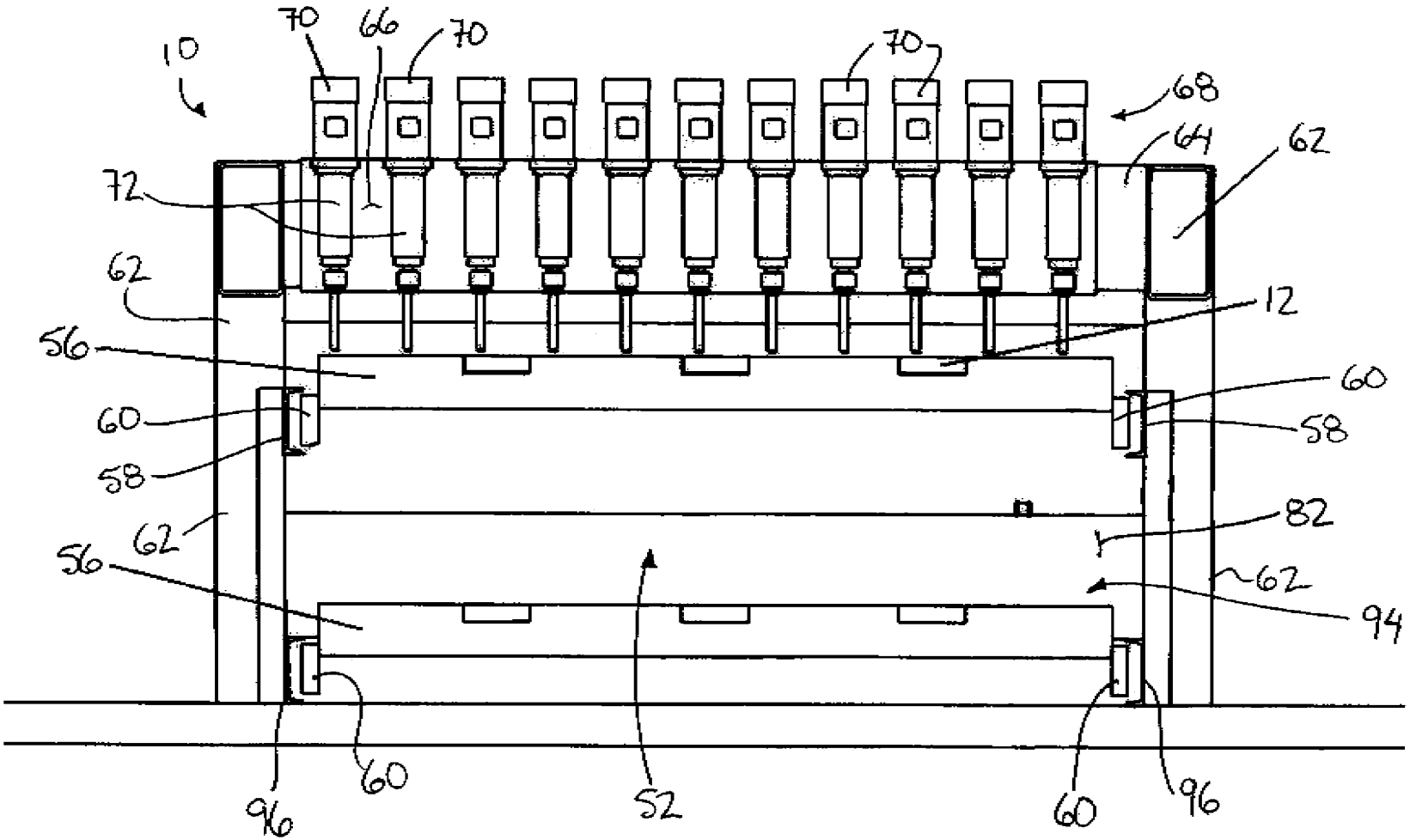
FIG. 3 is a front elevational view of the apparatus.
Figure 4:
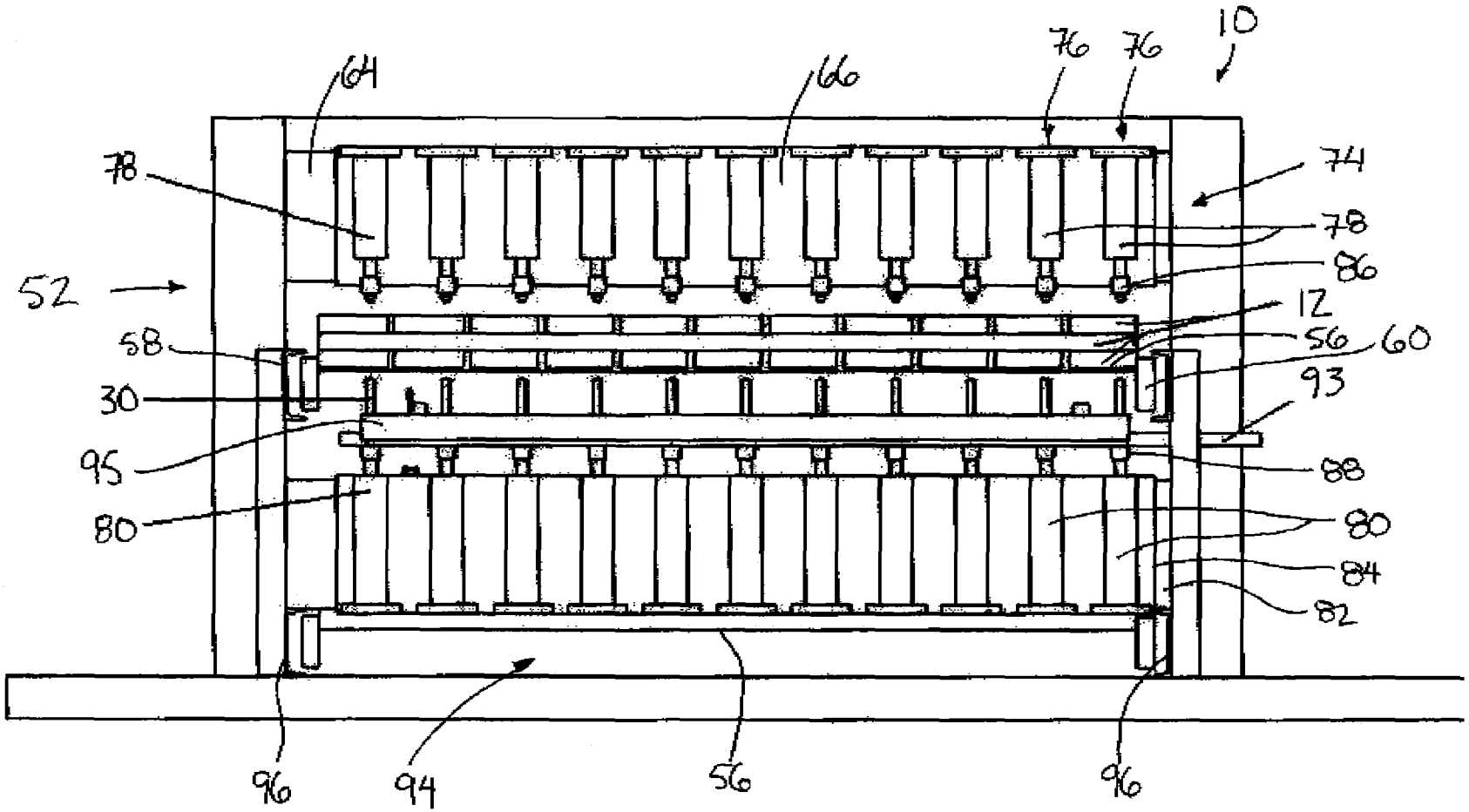
FIG. 4 is a rear elevational view of the apparatus.
Figure 5:
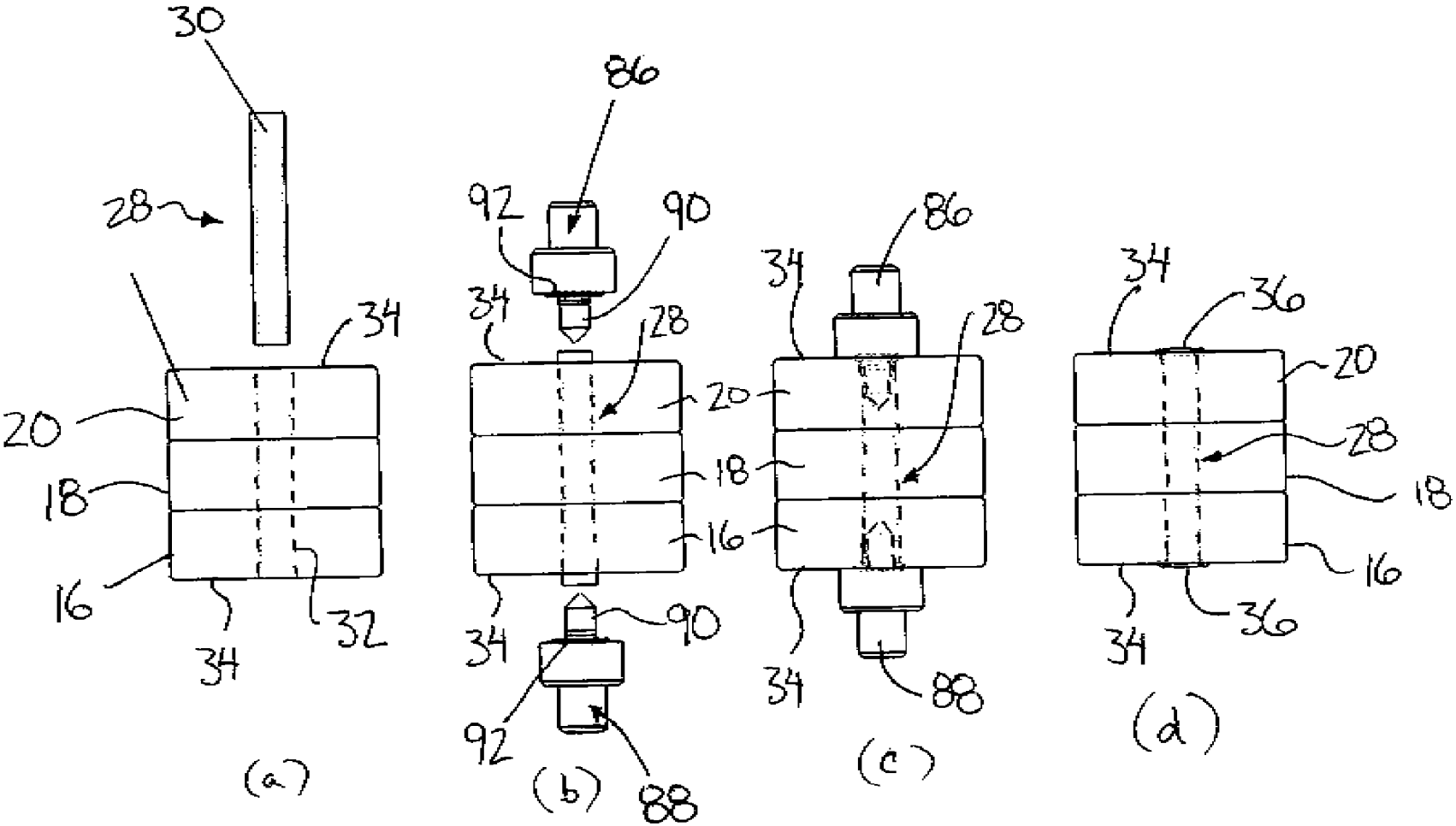
FIG. 5 is an elevational view of the rivet pressing operation illustrating steps (a) through (d) as a rivet blank is first positioned and is finally pressed into the hole at an intersecting location of the timbers.

Turning now more particularly to FIGS. 3, 4 and 5, the mat assembling apparatus 10 will now be described in further detail. The apparatus 10 defines an assembly line including a first loading station 50, a second assembly station 52 and a third unloading station 54 in series with one another.

A set of work supports 56 are provided in the form of wheeled carts having a horizontal platform upon which the timbers can be stacked in the desired configuration prior to joining with rivet fasteners 28. The work supports 56 generally include a rectangular frame having guides about the periphery thereof which assist in locating the proper positioning of the timbers in the stacked layers as well as indicating the proper orientation of the timbers.

The longitudinal direction of the mat, comprising the direction which the timbers of the first bottom layer and the third top layer extend, is supported by the work supports to be oriented in the direction of movement of the work supports along the assembly line. A set of tracks 58 are provided which extend in the longitudinal direction along opposing sides of the work supports for guiding the work supports and the timbers supported thereon from the first loading station, through the assembly station and finally to the third unloading station. The tracks each comprise an elongate channel having a U-shaped cross section in which an open side of the channel faces inwardly towards the opposing track. Wheels 60 rotatably supported along opposing sides of the work supports 56 are received within the channels forming the tracks for rolling movement of the work supports therealong.

At the assembly station, a frame of the apparatus is provided comprising two uprights 62 mounted at laterally opposed sides of the assembly line in alignment with one another along the longitudinal length of the assembly line. The uprights support a pair of overhead beams 64 spanning thereacross above the assembly station 52 receiving the work supports that carry the layered timbers. A forward carriage 66 is supported on a forwardmost or leading one of the overhead beams 64 and a rearward carriage 67 is supported on a rearwardmost or trailing one of the overhead beams 64, each for sliding movement along the respective beam 64 in a lateral direction, perpendicular to the direction of movement of the work supports relative to the frame.

A drilling array 68 is supported on a front side or leading side of the forward carriage 66 on the forwardmost beam 64. The drilling array 68 moves with the forward carriage 66 along the respective overhead beam in the lateral direction, perpendicular to the movement of the work support through the assembly line.

The drilling array comprises a row of drills 70 spaced apart from one another in the lateral direction across a full width of the work support and timbers supported thereon. One drill 70 is provided for each longitudinally extending timber of either the first or the third layers. Accordingly a drill 70 is provided for each intersecting location along a given lateral row of the intersecting locations 26 across the mat.

Each drill 70 includes its own driving mechanism 72 which is arranged to drive the drill bits downwardly at least a depth of all of the stacked layer of timbers to form a through hole at each intersecting location of the given row with which the drilling array 68 is aligned when the drilling array 68 is operated. The driving mechanisms 72 are operable independently so that the drills 70 may in turn be operated independently of one another. This permits the rivet mounting locations to be readily customized for any given lateral row of the mat. For example, intersecting locations at the gaps 40, which receive finger portions 38 of an adjacent mat, do not require fasteners during assembly by the apparatus 10 and accordingly the corresponding drills 70 and driving mechanisms 72 are not operated at these locations when the drilling array 68 is aligned with that particular row of intersecting locations.

An indexing mechanism is provided for advancing the work support relative to the drilling array 68. The indexing mechanism is supported on the frame of the apparatus to successively align the drill assembly 68 with each successive or subsequent lateral row of intersecting locations 26.

The forward carriage 66 and the drilling array supported thereon are permitted to shift in the lateral direction by approximately a width of one of the boards which extend in the longitudinal direction of the mat to permit location of the holes formed by the drill to be selected across the width of the longitudinally extending timbers. By periodically shifting the drilling array 68 in lateral direction, the resulting staggered pattern of holes receiving the rivet fasteners therethrough is produced. Shifting the work supports relative to the drilling array can also achieve the staggered pattern of holes receiving the rivet fasteners.

Also supported on the frame of the apparatus is a rivet press array 74 which includes a plurality of individual presses 76, each including an upper portion 78 and a lower portion 80. The rivet press array 74 presses a plurality of the rivet fasteners into the holes formed by the drilling array 68. The upper portions 78 of the press 76 are carried on the rearward carriage 67 slidable on the respective rearwardmost overhead beam 64 so that the rivet press array is positioned towards the trailing side of the frame. By supporting the upper portion of the rivet presses on the rearward carriage 67, the rivet press array is also movably in a lateral direction relative to the work support supporting the timbers thereon.

The carriages 66 and 67, along with the drilling array 68 and the rivet press array 74 supported respectively thereon, can be operated to be displaced laterally independently of one another for customized rivet offsetting patterns. Alternatively, the carriages 66 and 67 can be displaced in the lateral direction commonly and together to simplify the driving configuration of the lateral shifting. In yet a further alternative, the carriages 66 and 67 may be operatively linked to be displaced in opposing lateral directions when alternating between two opposed offset rivet fastener locations along each timber of the mat.

The frame also includes a lower beam 82 spanning between the two uprights in fixed relation therewith below the assembly station 52. Another lower carriage 84 is mounted on the lower beam 82 for lateral sliding movement therealong in the lateral direction. Movement of the lower carriage 84 on the lower beam is indexed to correspond with movement of the rearward carriage 67 on the rearwardmost overhead beam 64 which carries the upper portions of the rivet press array to ensure that the lower portions 80 of the rivet presses supported on the lower carriage 84 are always in alignment with the corresponding upper portions 78.

The presses 76 of the rivet press array 74 are spaced in the longitudinal direction from the drilling array by the width of a prescribed number of lateral rows of intersecting locations as measured in the longitudinal direction. In this manner the indexing mechanism also advances the work support relative to the rivet press array to simultaneously index and align the work support with the drilling array 68 and the rivet press array 74 to permit the drilling array and rivet press array to be simultaneously operated.

By providing a two row spacing between the drilling array and the rivet press array as in the illustrated embodiment, the rivet press array and the drilling array can always be shifted in the lateral direction together to produce the staggered pattern of rivet fasteners described above. In this instance, the rivet press is always aligned with one of the holes formed by the drilling array. By positioning the drilling array and the rivet press array spaced in the longitudinal direction from one another by a distance corresponding to the longitudinal spacing between an even number of lateral rows of intersecting locations, it is possible to always simultaneously shift the drilling array and the rivet press array laterally together when the rivet fastener location is staggered between two laterally offset positions.

Each rivet press 76 is individually operated so that the distance between the upper and lower portions of the press during the pressing operation is independent from one press to the next to accommodate for different board thicknesses at each intersecting location. Also, certain rivet presses may not operate for a given lateral row of fasteners, for example at the gaps 40 formed in the mat.

The upper portion 78 of each press includes an upper die 86 while the lower portion of each press includes a lower die 88. All of the dies include a centering portion 90 which is received within the end of a corresponding tubular rivet blank 30 to locate the die relative to the end of the rivet. As the upper and lower dies are forced towards one another by the press an annular forming portion 92 surrounding the centering portion 90 on each die forces the tube end outward to be flattened and enlarged in diameter at both ends as both ends of the rivet blank are pressed simultaneously. As shown in FIG. 5, in step (a), a rivet blank is initially positioned for insertion into a preformed hole where upon in step (b) the presses are activated so that the upper and lower dies begin to align themselves with the opposed ends of the tube. As shown in step (c), once the dies are fully pressed against opposing outer surfaces of the stacked timbers, both ends of the rivet blank are flattened against the corresponding outer surface of the mat as shown in step (a). Once the rivet fastener 28 has been formed the timbers are maintained under compression between the opposed ends of the rivet fastener.

In operation a loading mechanism 93 is provided which automatically loads the rivet blanks 30 onto one of the dies of each press for subsequent insertion into the hole, or alternatively loads the rivet blanks directly into the holes prior to alignment of the dies with the respective holes. The mechanism 93 includes a rack 95 upon which the rivet blanks are supported for proper alignment with the respective holes at the intersecting locations. The mechanism 93 is arranged to automatically reload rivet blanks 30 onto the rack thereof after each pressing operation. Assembly of the mat is thus fully automated.

Once a mat has been displaced in a longitudinal direction fully through the assembly station 52, the completed mat can be unloaded at the unloading station 54. The emptied work support can then be returned back to the first loading station for loading more timbers on the work support to form another mat. A return area 94 is defined below the assembly station 52 where a set of return tracks 96 are provided to return the emptied work support back to the loading station 50 beneath a different work support carried on the tracks 58 during assembly.

The method for assembling a wood mat as described above generally involves the following steps:

1. Multiple layers of boards are placed into a loading transport cart or work support. The first layer is positioned longitudinally. Each subsequent layer is positioned perpendicularly over the previous layer. The pattern formed is now placed in correct position for assembly or fastening.
2. The transport cart travels into the fastening or assembling station.
3. The transport cart and mat are indexed to the first fastening location.
4. A linear array of individually controlled drills is used to create holes of suitable diameter for the fastener.
5. The cart is indexed in order to position the previously drilled holes under the array of forming presses.
6. The rivet fasteners are picked up from the fastener rack and loaded onto each forming die or directly in the hole,
7. The forming presses are activated which closes the forming dies onto the rivet.
8. The forming dies retract.
9. The fastener rack is refilled by an automated system after every forming operation.
10. Simultaneously, during the forming operation, the drilling operation for the next linear array of holes is taking place.
11. Arbitrary lines of holes can be shifted left or right, forming a zigzag pattern in order to avoid twisting of the mat into a parallelogram shape. Shifting is performed by side shifting of either the transport cart or the entire assembly station.
12. The cart is repeatedly indexed until all the prescribed rivets have been inserted.
13. The transport cart travels to the unloading station at an out-feed area.
14. The assembled mat is extracted from the cart either manually or automatically.
15. The empty cart is reintroduced at the loading station of an in-feed area.
16. A plurality of carts will allow for one mat to be loaded at the in-feed, one mat to be assembled at the assembly station, and one mat to be unloaded at the out-feed area simultaneously.

Although rivet fasteners have been described with regard to the illustrated embodiment, advantages of the present invention described above can be realised using other types of fasteners which can be assembled in an automated manner. Other types of fasteners which may be suitable for automated assembly by a fastener array including press type fasteners assembled by a pressing operation including for example co-operating male and female fasteners joined with one another under compressive force. Other fasteners suitable for automated assembly include welded fasteners also having cooperating parts for being joined, for example a electrical current weld, to compressively join timbers between opposing ends of the fastener.

Regardless of the type of fastener, the fastener array is preferably operated in an automated manner in proximity to the drilling array, but spaced therefrom by a prescribed number of lateral rows of intersecting locations so that the drilling array and fastener array are always indexed together and can be operated simultaneously on a given mat being assembled. Depending upon the desired fastener pattern, the drilling array and the fastener array can be shifted in the lateral direction together, opposite one another or in an otherwise independent manner.

The fastening devices of the fastener array are also preferably operated independently of one another to independently provide compressive force at the intersecting locations where the fasteners are mounted regardless of whether the fasteners are mounted by a rivet press operation, a press fit operation or a welding operation for example.

In order to reduce the tendency of the wood to split at the front and rear rails, a metal strip can be fastened along the edge using suitable fasteners either as part of the fastening system described above or using separate fasteners. In this way, the mats may have increased strength or the mats may have a comparable strength to existing mats but use less expensive wood as the base material so that pine or spruce or poplar may be used to replace the much more expensive oak commonly used. The metal strip may be along the font and rear edges only or may be applied along the side edges also. The metal strip may be flat and applied only along the top surface or may be an angle which encases the edge of the plank at the edge of the mat Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of assembling a rectangular wood mat comprising top, middle and bottom layers of elongate timbers in which the timbers of each layer lie parallel to one another across the mat, the timbers of the middle layer lying at right angles to the timbers of the top and bottom layers so that the timbers of the middle layer intersect a plurality of the timbers of the top and bottom layers at a plurality of respective intersecting locations; the method comprising;

supporting the top, middle and bottom layers of timbers on a work support with said intersecting locations arranged in lateral rows;

providing a drilling array arranged to drill holes through the layers of timbers at the respective intersecting locations in one of the lateral rows of the intersecting locations;

providing a fastener array comprising a plurality of fastener mounting devices operable to mount respective fasteners within the holes formed by the drilling array in one of the lateral rows of the intersecting locations;

simultaneously displacing the work support relative to the drilling array and the fastening array in a longitudinal direction substantially perpendicular to the lateral rows;

operating the drilling array when the drilling array is successively aligned with each lateral row of the intersecting locations at each row of the intersecting locations to form the holes at selected ones of the intersecting locations of the timbers;

and operating the fastener array when the fastening array is successively aligned with each lateral row of the intersecting locations at each row of the intersecting locations so as to compressively join the plurality of layers of timbers with one another with the fasteners at the selected ones of the intersecting locations of the timbers.

2. The method according to claim 1 including supporting the timbers in three layers in which the timber of each layer are oriented perpendicularly to the timbers of an adjacent layer.

3. The method according to claim 1 including simultaneously operating the drilling array and the fastener array each time the work support is displaced relative to both the drilling array and the fastener array to be aligned with respective lateral rows of intersecting locations.

4. The method according to claim 1 including periodically displacing the drilling array and the fastener array in a lateral direction perpendicularly to the longitudinal direction.

5. The method according to claim 4 including displacing the drilling array and the fastener array in the lateral direction together.

6. The method according to claim 4 including displacing the drilling array and the fastener array in the lateral direction independently of one another.

7. The method according to claim 4 including displacing the drilling array and the fastener array in the lateral direction opposite one another.

8. The method according to claim 1 wherein the fasteners comprise rivet fasteners and wherein the method includes operating the fastener mounting devices to simultaneously press opposing ends of each rivet fastener directly against respective outer surfaces of the mat.

9. The method according to claim 8 including operating each fastener mounting device of the fastener array independently of the other fastener mounting devices to apply a compressive force to the timbers independently of the other fastener mounting devices when mounting the fasteners.

10. The method according to claim 1 wherein the drilling array comprises a plurality of drills and wherein the method includes operating the drills of the drilling array independently of one another.

11. The method according to claim 1 including drilling two holes and inserting two respective fasteners in at least some of the intersecting locations.

12. The method according to claim 1 including drilling a pair of holes and mounting a respective pair of fasteners therein at each intersecting location at both longitudinally opposed ends of the mat.

13. The method according to claim 1 including displacing the work support relative to the drilling array and the fastener array in the longitudinal direction along a first track when timbers are supported on the work support from a loading station where the timbers are loaded onto the work support, to an assembly station where the drilling array and the fastener array are located, and to an unloading station where an assembly mat is removed from the work support, and returning the work support from the unloading station to the loading station in the longitudinal direction along a second track below the first track.

* * * * *